US005756176A

United States Patent [19]

Feld

[11] Patent Number: 5,756,176

[45] Date of Patent: May 26, 1998

[54] CARPET TRANSITION STRIP AND METHOD OF INSTALLING THE SAME

[76] Inventor: Larry Feld, 1665 Woodland Rd., Rydal, Pa. 19046-1237

[21] Appl. No.: 691,238

[22] Filed: Aug. 2, 1996

[51] Int. Cl.[6] ..... A47G 27/04

[52] U.S. Cl. ..... 428/48; 428/58; 428/119; 428/131; 428/16; 428/7

[58] Field of Search ..... 428/48, 58, 119, 428/131, 192; 16/16, 7, 1 R; 52/717.03, 717.05

[56] References Cited

U.S. PATENT DOCUMENTS

| | | | |
|---|---|---|---|
| 1,966,020 | 7/1934 | Rowley | 16/7 |
| 2,258,314 | 10/1941 | Bonnell | 16/7 |
| 2,449,904 | 9/1948 | Lorraine | 16/7 |
| 2,644,977 | 7/1953 | June | 16/7 |
| 2,677,145 | 5/1954 | Adams | 16/16 |
| 2,770,002 | 11/1956 | Thompson | 16/7 |
| 2,980,943 | 4/1961 | Barnes et al. | 16/7 |
| 2,996,751 | 8/1961 | Roby et al. | 16/7 |
| 4,069,542 | 1/1978 | Carder | 16/16 |
| 4,478,017 | 10/1984 | Brown et al. | 52/209 |
| 4,837,889 | 6/1989 | Saotome | 16/4 |

OTHER PUBLICATIONS

Schluter–Systems Brochure, 10–92, 1–8.

*Primary Examiner*—Alexander Thomas
*Attorney, Agent, or Firm*—Norman E. Lehrer

[57] ABSTRACT

A transition strip for providing a smooth transition between the margin of a rigid flooring and the margin of adjacent carpeting. The transition strip comprises a substantially planar elongated base member with a pair of opposing side edges. A vertical wall extends upwardly from one of the opposing side edges. Extending outwardly and downwardly from the top of the vertical wall is an angled wall.

4 Claims, 2 Drawing Sheets

CARPET TRANSITION STRIP AND METHOD OF INSTALLING THE SAME

BACKGROUND OF THE INVENTION

The present invention relates to a carpet transition strip and, more particularly, to such a strip that is utilized to provide a smooth transition between the margin of a rigid floor covering and the margin of adjacent carpeting. The invention also relates to a method of installing such a carpet transition strip.

Carpeted rooms are frequently located adjacent rooms with rigid floor coverings. The margins or boundaries between the carpeted room and the non-carpeted room often appear to be flush with one another. However, since the carpeting is supple and yielding and the adjacent surface is rigid and unyielding, a discernable difference can be readily felt by a person walking over the joint formed between the rigid and carpeted floors. Further, as time goes by, the area of carpeting adjacent the margin frequently becomes permanently flattened so that it no longer appears flush with the margin of the rigid floor. Moreover, the levels of adjacent rooms are sometimes uneven so that the rigid floor covering and the carpeting are not properly aligned after they are installed.

In recognition of the foregoing, a device has been disclosed in U.S. Pat. No. 2,980,943 to Barnes et al. which is secured over the joint formed between the margins of rigid floor covering and carpeting in order to accommodate the differences in elevation between the same. The device disclosed in the Barnes et al. patent includes an extruded member with a base member, a vertical wall, and a top wall. Two portions extend downwardly from opposing ends of the top wall.

The Barnes et al. device is extremely difficult to install. Specifically, this device is designed to extend under the carpeting so that one of the downwardly extending portions firmly contacts the rigid floor covering while the other portion contacts the carpeting. Thereafter, the device is nailed to the carpeting.

Moreover, the Barnes et al. device is ineffective for use in situations where the rigid floor covering is comprised of a plurality of tiles. Specifically, one of the downwardly extending portions of Barnes et al. would firmly contact the edges of a row of tiles after installation. Therefore, the entire device would have to be removed even if only one of the tiles had to be replaced.

U.S. Pat. No. 4,069,542 to Carder shows a carpet strip that is utilized to secure carpeting adjacent a wall member. The Carder carpet securing strip comprises a metal extrusion with a base member, an upright rib section and an outwardly extending carpet engaging portion which projects outwardly from the upper end of the rib section. The carpet engaging portion includes a plurality of teeth which are utilized to engage the undersurface of a section of carpeting which is folded over the engaging portion and which is located against a wall. The Carder securing strip could not be used to effectively create a smooth transition between the margins of a rigid floor and a carpeted floor since the plurality of teeth extend at a 90° angle from the upright rib section. Additionally, the teeth could potentially harm a person who steps on the same while not wearing shoes or other protective foot coverings.

SUMMARY OF THE INVENTION

The present invention is designed to overcome the deficiencies of the prior art discussed above. It is an object of this invention to provide a carpet transition strip that creates a smooth transition between the margins of a rigid floor covering and carpeting.

It is another object to provide such a transition strip that is easy to install.

In accordance with the illustrative embodiments, demonstrating features and advantages of the present invention, there is provided a carpet transition strip for providing a smooth transition between the margin of a rigid floor covering and the margin of adjacent carpeting. The transition strip comprises a substantially planar elongated base member with a pair of opposing side edges. A vertical wall extends upwardly from one of the side edges. Extending outwardly and downwardly from the top of the vertical wall is an angled wall.

Other objects, features and advantages of the invention will be readily apparent from the following detailed description of a preferred embodiment thereof taken in conjunction with the drawings.

BRIEF DESCRIPTION OF THE DRAWINGS

For the purpose of illustrating the invention, there is shown in the accompanying drawings one form which is presently preferred; it being understood that the invention is not intended to be limited to the precise arrangements and instrumentalities shown.

DETAILED DESCRIPTION OF THE PREFERRED EMBODIMENT

Figure 4:
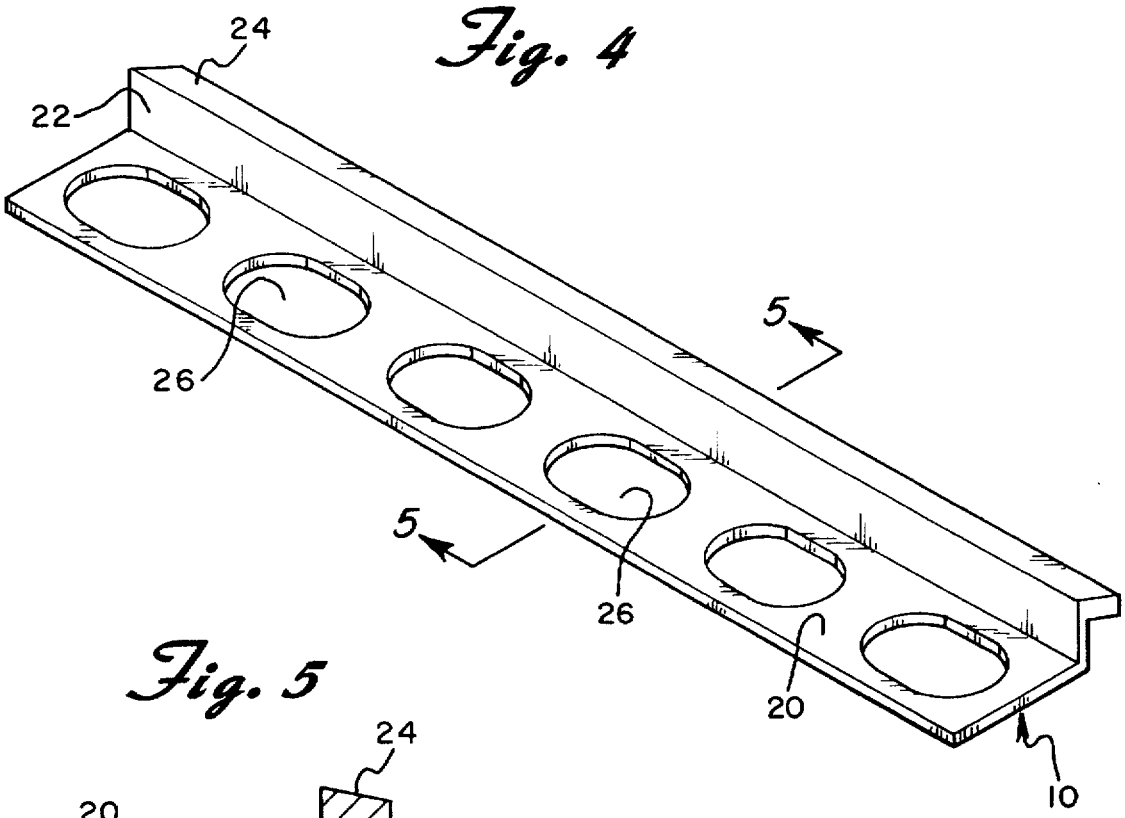
FIG. 4 is a front perspective view of the carpet transition strip.
Figure 5:
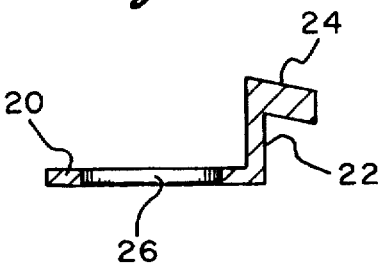
FIG. 5 is a cross-sectional view taken along lines 5—5 of FIG. 4.
Figure 6:
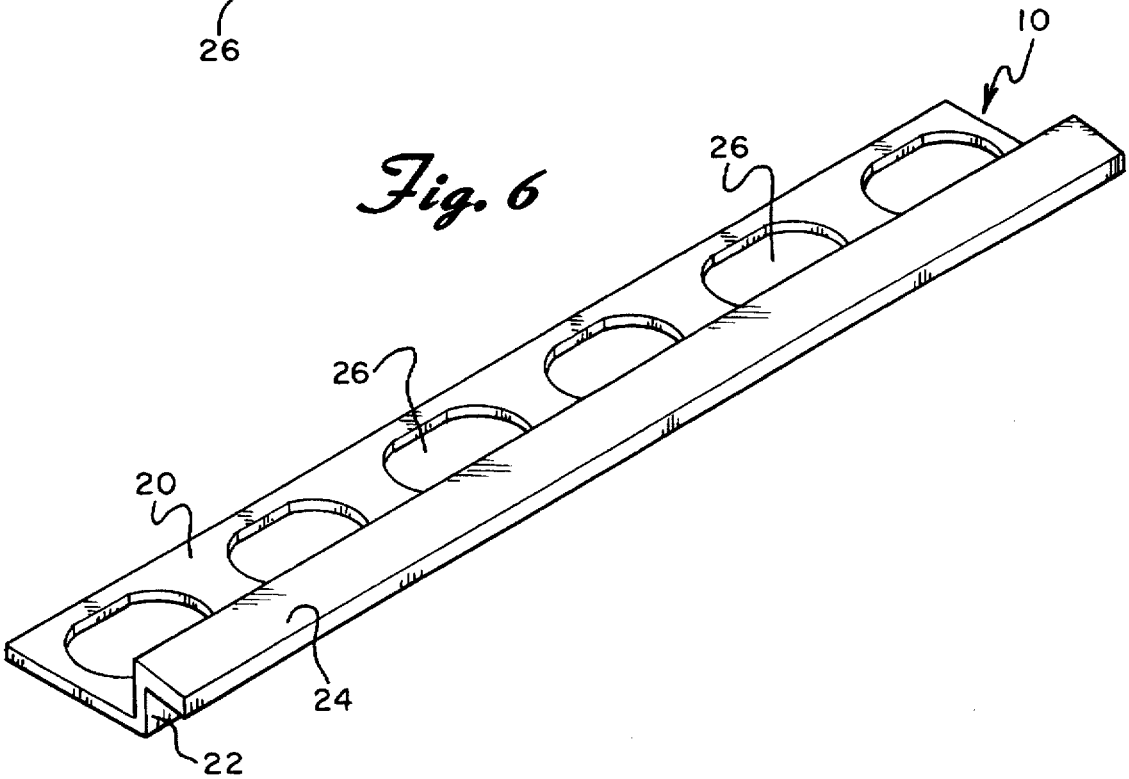
FIG. 6 is a rear perspective view of the carpet transition strip.

Referring now to the drawings in detail wherein like reference numerals have been used throughout the various figures to designate like elements, there is shown in FIG. 4 a carpet transition strip constructed in accordance with the principles of the present invention and designated generally as 10.

The transition strip 10 provides a smooth transition between the margins or edges of a rigid floor covering 12 and carpeting 14 as more fully described below. The rigid floor covering often comprises a plurality of ceramic tiles secured to a floor structure 16 by means of a hardenable cementitious or other adhesive material 18. It should be understood, however, that the invention is not limited to the use of ceramic tiles . Other materials can be utilized with the present invention such as vinyl tiles and sheet material made from vinyl, linoleum, or the like. The transition strip 10 essentially comprises a planar elongated base member 20, a vertical wall 22 and an angled wall 24. The transition strip 10 is preferably comprised of extruded metal. However, it can be comprised of a variety of other materials. Furthermore, the transition strip 10 could be molded or stamped, if desired.

Figure 1:
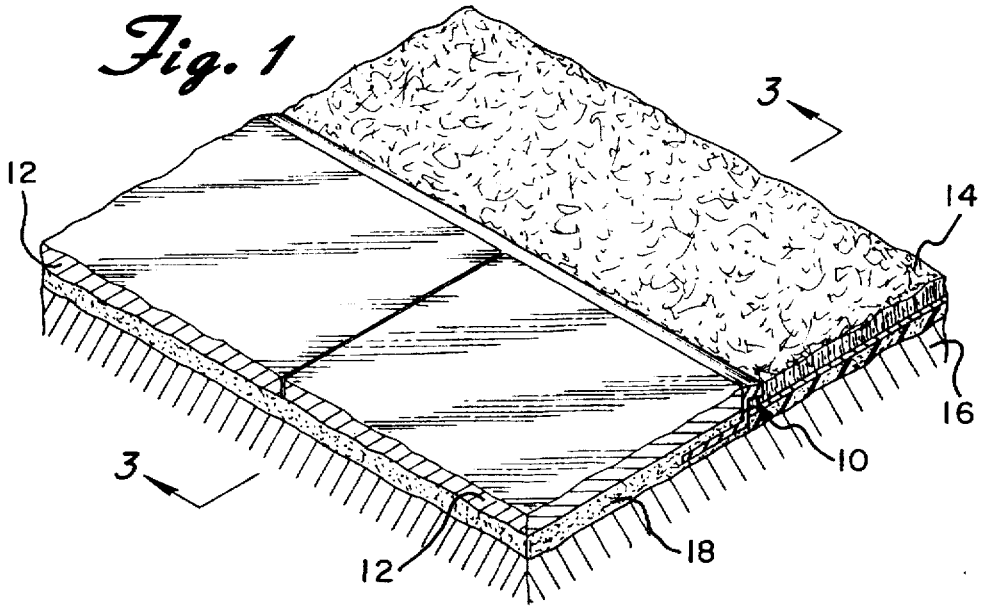
FIG. 1 is a perspective view of the carpet transition strip of the present invention shown secured in place between a rigid tile floor and a carpeted floor.
Figure 3:
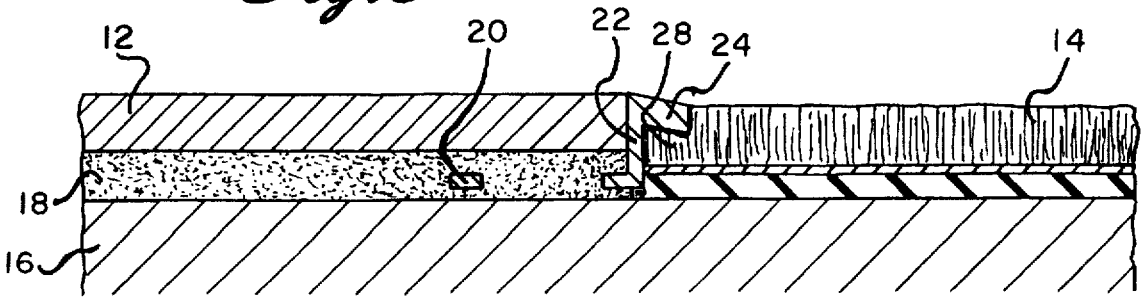
FIG. 3 is a cross-sectional view taken along lines 3—3 of FIG. 1.

In the preferred embodiment, the elongated base member 20 includes a plurality of apertures 26 formed therethrough. The apertures are adapted to allow the elongated member to be embedded in the hardenable cementitious material 18 as shown in FIGS. 1 and 3 and as more fully described below. The vertical wall 22 extends upwardly from one side edge of the elongated base member 20. The angled wall 24 preferably extends outwardly and slightly downwardly from the vertical wall. The other side of the vertical wall is devoid of any additional structural elements.

The preferred dimensions of the transition strip 10 are as follows. The elongated base member 20 is preferably about 1" wide, the vertical wall 22 is preferably about 7/16 high, and the angled wall 24 is preferably about 5/16 wide. The length of the transition strip 10 corresponds to the length of the margins formed between the rigid floor covering and the carpeting. Accordingly, the transition strip 10 would preferably be made available in long lengths of eight feet or more and could be cut as needed or placed end to end to make longer lengths. Similarly, the height of the carpet transition strip corresponds to the height of the particular floor covering being utilized.

Figure 2:
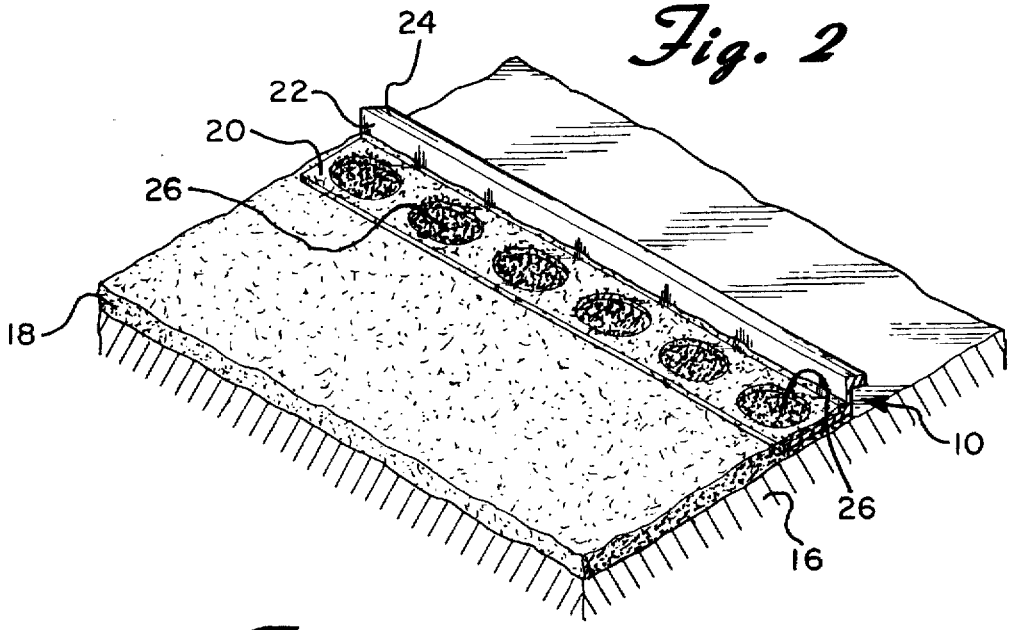
FIG. 2 is a perspective view of the carpet transition strip shown secured in adhesive before the tile and carpeting are installed.

In order to facilitate an understanding of the principles associated with the foregoing transition strip, its operation will now be briefly described. A hardenable cementitious material 18 is applied on top of a predetermined area of a floor structure 16. The elongated base member 20 of the carpet transition strip 10 is positioned on top of the cementitious material adjacent the boundary of the predetermined area and is forced downwardly. The apertures 26 allow the elongated base member 20 to move downwardly into the cementitious material so that the elongated base member is covered by the same (FIGS. 2 and 3). Thereafter, a plurality of tiles 12 are positioned on top of the cementitious material. The edges of a row of tiles 12 are aligned adjacent one side of the vertical wall 22 of the carpet transition strip 10 above the base member 20. Thereafter, the cementitious material 18 is allowed to harden. Carpeting 14 is then installed on top of the floor structure 16 adjacent the other side of the vertical wall. The free end or margin 28 of the carpeting is positioned under the downwardly extending angled wall 24 as illustrated in FIG. 3 in order to hide any imperfections in the carpeting end and to provide a smooth transition between the tiles 12 and the carpeting 14. The angled wall 24 of the carpet transition strip 10 also prevents the carpeting 14 from unravelling as a result of foot traffic and/or suction created by a vacuum cleaner.

The present invention may be embodied in other specific forms without departing from the spirit or essential attributes thereof and accordingly reference should be made to the appended claims rather than to the foregoing specification as indicating the scope of the invention.

What is claimed is:

1. A flooring arrangement including a rigid floor covering and a carpeting secured on top of a floor structure with an edge of said rigid floor covering adjacent an edge of said carpeting and a transition strip positioned therebetween for providing a smooth transition between the edges of said rigid floor covering and said carpeting:

said transition strip including a substantially planar elongated base member having a pair of opposing side edges and a plurality of apertures therein, a vertical wall extending upwardly from one of said opposing side edges, and an angled wall extending outwardly and downwardly from only one side of said vertical wall;

a quantity of hardenable material being secured to a predetermined area of said floor structure;

said elongated base member being embedded in said hardenable material so that said material passes through said apertures in said base member to secure the same to said floor structure;

said edge of said rigid flooring being positioned on top of said elongated base member and in substantial alignment with said vertical wall, and said edge of said carpeting being positioned adjacent said vertical wall under said angled member.

2. The flooring arrangement of claim 1 wherein a quantity of said hardenable material lies between said elongated base member and said rigid floor covering.

3. The flooring arrangement of claim 2 wherein said rigid floor covering includes floor tiles.

4. A method of installing a carpet transition strip in order to create a smooth transition between the margins of a rigid floor covering and carpeting secured on top of a floor structure, said transition strip including an elongated base member with a plurality of apertures formed therein, a vertical wall extending upwardly from said base member, and an angled member extending outwardly and downwardly from said vertical wall between the margin of a rigid floor covering and the margin of adjacent carpeting, said method comprising the steps of:

applying a quantity of hardenable material to a predetermined area of said floor structure;

placing said elongated base member into said hardenable material so that said hardenable material flows through said apertures in said base member;

positioning said rigid flooring on top of said hardenable material and against one side of said vertical wall of said carpet transition strip;

allowing said hardenable material to harden;

securing carpeting to said floor structure on the other side of said vertical wall, and positioning the free edge of said carpeting under said angled member so that said angled member extends over said margin of said carpeting.

* * * * *